US005966751A

United States Patent [19]

Chiarelli

[11] Patent Number: 5,966,751

[45] Date of Patent: Oct. 19, 1999

[54] PORTABLE HAIR WASHING APPARATUS

[76] Inventor: Shirley A. Chiarelli, 3183 Uplands Drive, Ottawa, Ontario, Canada, K1V 1A9

[21] Appl. No.: 09/097,395

[22] Filed: Jun. 16, 1998

Related U.S. Application Data

[63] Continuation-in-part of application No. 08/634,935, Apr. 19, 1996, abandoned.

[51] Int. Cl.[6] ..... A45D 19/04

[52] U.S. Cl. ..... 4/516; 4/523

[58] Field of Search ..... 4/515, 516, 519, 4/523

[56] References Cited

U.S. PATENT DOCUMENTS

| | | | |
|---|---|---|---|
| 981,448 | 1/1911 | Matthews | 4/654 X |
| 3,068,491 | 12/1962 | Perekrestenko | 4/516 |
| 3,363,620 | 1/1968 | Collins | 4/515 X |
| 3,465,370 | 9/1969 | Chernick | 4/515 |
| 4,512,043 | 4/1985 | Nolan | 4/516 |
| 4,651,361 | 3/1987 | Nolan | 4/516 |
| 5,245,713 | 9/1993 | Tickle | 4/516 |
| 5,263,206 | 11/1993 | Rupp | 4/516 |

FOREIGN PATENT DOCUMENTS

95/04484 2/1995 WIPO .

*Primary Examiner*—Robert M. Fetsuga
*Attorney, Agent, or Firm*—W. Charles Kent

[57] ABSTRACT

There is provided a new and useful portable hair washing apparatus. The apparatus comprises, in combination, a basin defined by a front wall, opposite facing side walls, a rear wall and a floor. The basin has neck support means and head support means, as well as drainage openings. There is also provided a flexible drainage hose releasably connectable to the drainage openings and a receptacle for receiving waste water and other debris from the hose. There is further provided cover means releasably securable to the basin and, when in position secured thereto, the cover means and basin constitute a carrying case.

19 Claims, 3 Drawing Sheets

PORTABLE HAIR WASHING APPARATUS

This application is a continuation-in-part of application Ser. No. 08/634,935 filed on Apr. 19, 1996 abandoned.

BACKGROUND OF THE INVENTION

The present invention relates to a portable hair washing apparatus and more particularly relates to a basin with head and neck support means which cooperates with a receptacle to provide an all inclusive apparatus for easy hair washing of bed-ridden patients.

It is often difficult and awkward to wash the hair of a person who is bedridden or who has reduced mobility. The person washing the patient's hair must contend with the patient's lack of mobility and the fact that convenient water supply, cleaning tools and drainage openings are not readily at hand. For the patient, the process often causes a significant amount of discomfort and pain.

Attempts have been made in the prior art to address these problems by means of portable hair washing units, with limited success. Many of these units have been bulky difficult to set up and awkward to use. Often, the wash basin is undersized so as to restrict the movement of the washer's hands within the basin and the unit is not provided with a convenient manner in which to dispose of the waste water and debris from the basin. Further, many of the prior art units lack the necessary support for the head of the patient whose hair is being washed, therefore requiring the use of additional pillows or similar support means. A portable water supply means, which travels with the unit, is also not readily available in the prior art. Reference is made for example to U.S. Pat. No. 4,512,043 of Nolan, issued Apr. 23, 1985, U.S. Pat. No. 5,245,713 of Tickle, issued Sep. 21, 1993 and U.S. Pat. No. 5,263,206 of Rupp, issued Nov. 23, 1993. Other references of general background interest include Hearn, PCT application Ser. No. WO 95104484 published Feb. 16, 1995, U.S. Pat. No. 3,068,491 of Perekrestenko issued Dec. 18, 1962, U.S. Pat. No. 3,465,370 of Chernick issued Sep. 9, 1969, U.S. Pat. No. 3,363,620 of Collins issued Jan. 16, 1968, U.S. Pat. No. 981,448 of Matthews issued Jan. 10, 1911 and U.S. Pat. No. 4,651,361 of Nolan issued Mar. 24, 1987.

SUMMARY OF THE INVENTION

It is thus an object of the present invention to provide an improved portable hair washing apparatus.

In accordance with one aspect of the invention there is provided a portable hair washing apparatus comprising, in combination a basin defined by a front wall, opposite facing side walls, a rear wall and a floor, the front wall having an upper portion angled outwardly and upwardly relative to the basin to serve as a shoulder and back support. The basin has neck support, a head support and drainage openings for draining waste water and debris from the basin. A flexible drainage hose is releasably connectable to the drainage openings. A receptacle receives waste water and other debris from the hose. There is further provided cover means releasably securable to the basin and, when in position secured thereto, the cover means and basin constitute a carrying case. The neck support, head support and back and shoulder support are contiguous with the upper portion and relatively positioned so as to comfortably maintain the head of a person whose hair is being washed elevated above water and other material within the basin during the hair washing operation, while that person is lying on his or her back.

In another aspect of the invention, the basin includes a contiguous back and shoulder support.

In a preferred embodiment of the invention, there is provided a portable water supply comprised of a pitcher, having a handle and an output means.

In another preferred embodiment of the invention, the portable water supply is of a size to fit within the receptacle when the apparatus is not in use and the receptacle is of a size to fit within the basin when the apparatus is not in use and when the apparatus is being transported with the cover secured to the basin to form the carrying case.

The apparatus according to the present invention can be used in hospitals, nursing homes and the like, but is particularly applicable to home health care specialists such as Health Care Nurses (USA) and Victorian Order of Nurses (Canada). The apparatus is designed to be all-inclusive so that the care givers will have everything at his or her fingertips and will not have to deal repeatedly with the same problems that arise from not having a complete and all inclusive hair-washing unit. The unit is both lightweight and portable enabling the care-giver to easily transport it from one location to the next. It is designed for easy assembly and enables the care giver to perform the hair washing process without assistance.

BRIEF DESCRIPTION OF THE DRAWINGS

These and other advantages of the invention will become apparent upon reading the following detailed description and upon referring to the drawings in which.

Figure 1:
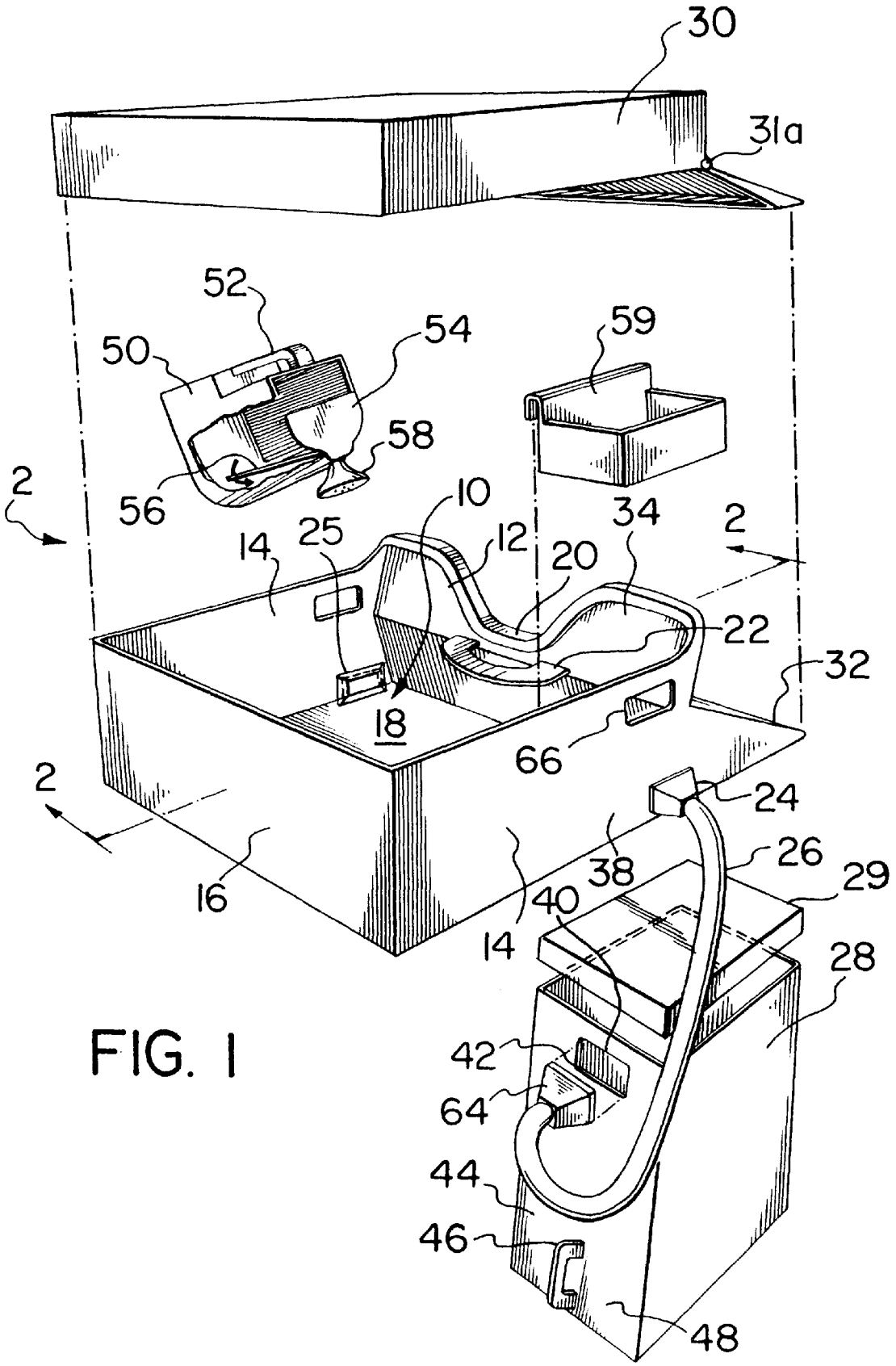
FIG. 1 is a perspective, exploded view of the apparatus in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates, in partially exploded form, a portable hair washing apparatus 2 suited for use in washing the hair of bed-ridden patients or persons with mobility restrictions. The apparatus 2 comprises a basin 10 defined by a front wall 12, oppositely facing side walls, 14, a rear wall 16 and a floor 18. For sanitary reasons all of the inside edges and corners of the basin 10 are rounded or contoured to facilitate cleaning of the basin 10.

The basin 10 further comprises neck support means 20 within the front wall 12 and head support means 22, extending into the basin 10 from an interior face of the front wall 12. Drainage openings 24 are also provided within the basin 10. This drainage openings 24 is preferably in the form of a generally rectangular aperture in each of side walls 14. Releasably connectable to and co-operable with drainage openings 24 is a flexible drainage hose 26 which carries the waste water and other debris from the basin 10 to the receptacle 28. As can be seen in FIG. 1, the diameter of hose 26 is relatively large to avoid blockage from hair or other debris caught up in the waste water.

Figure 3:
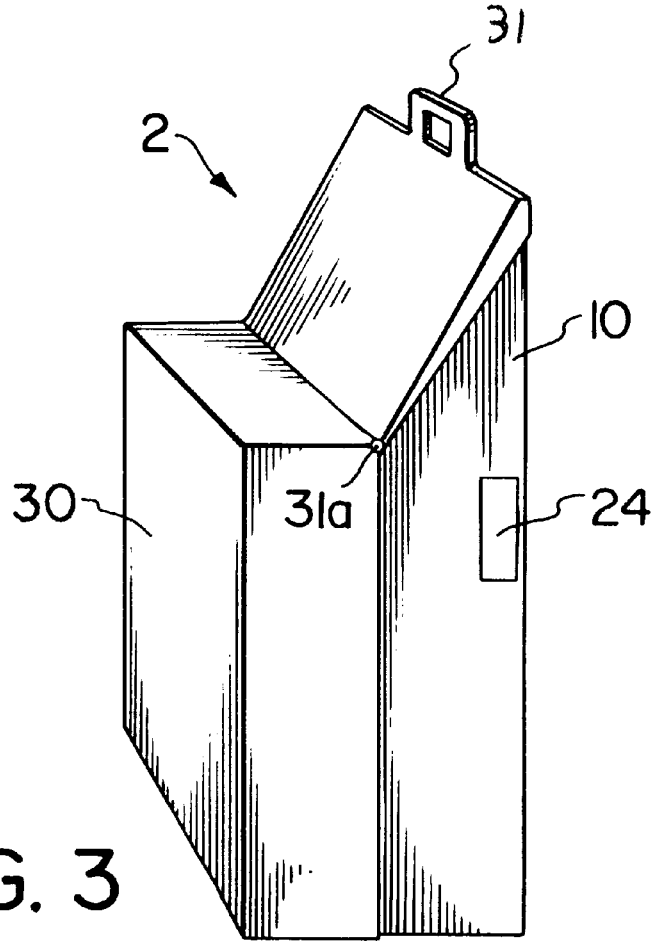
FIG. 3 is a perspective view of the apparatus with the cover secured to the basin.

The apparatus 2 further comprises a cover 30, releasably securable to the basin 10, and when in position secured thereto, the cover 30 and the basin 10 constitute a carrying case. Cover 30 includes a handle 31 to ensure portability of the apparatus 2. The front part of cover 30, as can be seen in FIGS. 1 and 3, is hinged to the main body portion of cover 30, at 31*a* as illustrated. This hinged arrangement facilitates the placing of cover 30 securely over basin 10 and its removal therefrom.

As in the basin 10, all of the inside edges and comers of receptacle 28 and cover 30 are rounded or contoured for sanitary reasons. Basin 10 and cover 30 are preferably made from sturdy plastic.

The neck support means 20 is of a U-shaped configuration having a wider, deeper and flatter cross-section, as seen in FIG. 1, resulting in an elongated U-shaped opening. The neck support means 20 merges smoothly into the horizontally oriented head rest 22 which is slightly concavely contoured to receive the back of the patient's head and is provided with openings to allow water drainage into the basin 10 and provide ventilation for hair drying. The head rest is positioned slightly lower than the neck rest. This configuration of the neck support means 20 and head rest 22 provides a more comfortable and physically preferable position for the patient without hyperextension of the patent's neck.

The basin 10 is further preferably provided with contiguous back and shoulder support 32 extending downwardly and outwardly from an outside face of an upper portion 34 of the front wall 12. The back and shoulder support 32 is in the form of a gently sloped and padded ramp designed to provide consistent, stable and comfortable support for the patient's upper back and shoulders during the hair-washing, and drying, process. The need for additional support means, such as pillows or cushions, is thereby eliminated. The neck support 20 and head rest 22 together with back and shoulder support 32 allow the patient to remain in a horizontal position while the hair is being washed and dried.

The upper portion 34 is angled upwards and outwards from front wall 12. The head and back and shoulder supports eliminate stress and hyperextension on the patient's neck. This is particularly important for bed-ridden patients since the bed will offer little support during the hair washing process. The lower portion 36 of front wall 12 is angled downwards and forwards from the interior of the basin 10 towards the back and shoulder support 32 allowing additional room for the hands of the person who is performing the hair washing, thus facilitating the process.

Drainage openings 24 are comprised of at least one aperture located in a lower forward portion 38 of side walls 14. Preferably, the drainage apertures are rectangular in shape, with one in each of the side walls 14 of the basin 10. This configuration allows the waste water, shampoo residue and other debris to drain quickly and easily from basin 10 into receptacle 28. There is further provided a drainage cap 25 which is selectively and releasably securable to either of the drainage apertures 24 when that aperture is not in use. Thus, the washer can select from which side of basin 10 the waste water is to be drained, cap the aperture in the oppositely facing side wall 14 and position the drainage hose 26 and receptacle 28 appropriately. When not in use, the drainage apertures 24, when uncapped, provide ventilation of the basin 10, preventing the growth of mildew within the basin 10 and the development of unpleasant odors.

Receptacle 28 has a removable lid 29 which is preferably transparent and is of a sufficient size to accommodate the entire amount of waste water, shampoo residue and other debris from a normal hair wash. The receptacle 28 is further provided with an aperture 40 in an upper portion 42 of an upstanding wall 44 and a handle 46 attached to wall 44 at a lower portion thereof 48. The aperture 40 and handle 46 facilitate the emptying of the contents of receptacle 28 into a nearby toilet or sink, as convenient.

Figure 5:
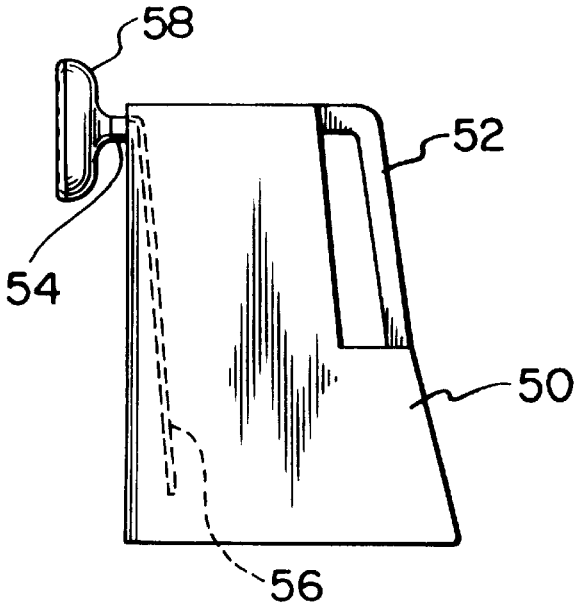
FIG. 5 is a side elevation view of the portable water supply of the present invention.

The apparatus 2 also includes a portable water supply means, shown in FIG. 5 as pitcher 50, of a sufficiently generous size so as to be able to complete the washing process without the need to refill the supply means. Pitcher 50 comprises a handle 52 and output means in the form of a pour spout 54. Spout 54 originates from the bottom and interior of pitcher 50 such that there is created a splash-reducing interior baffle of an elongated, downwardly disposed member 56 within the pitcher 50. A perforated cap 58 may be provided which can be attached to the end of the spout 54 such that the water flowing from the pitcher 50 is in the form of a spray, thereby allowing the water to cover a larger area of the patient's head and reducing the amount of water used in the washing process.

When the apparatus 2 is in use, the underside of cover 30 is of a configuration to provide a convenient area in which to place shampoo, brushes, damp cloths or towels and other tools used in the hair washing process. This is preferable to the use of recessed wells in the floor 18 of basin 10, as common in the prior art, in that such recessed wells often collect dirt and residue, thereby creating unsanitary cleaning conditions and significantly increasing the required clean-up time. There is also provided a basket 59 which is designed to hook on to a top edge of one of the side walls 14 or the rear wall 16 of the basin 10 to further provide a convenient area for the shampoo, brushes and the like.

Figure 4:
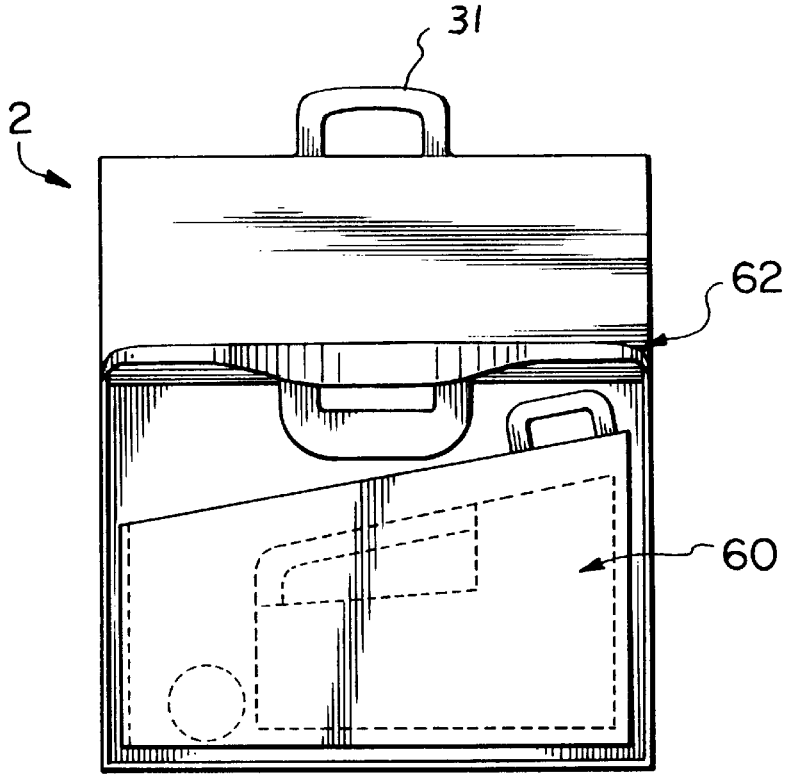
FIG. 4 is a top plan view of the apparatus when not in use.

As is most clearly shown in FIG. 4, the water supply means 50 and the basket 59 are of a size to permit storage in the receptacle 28 when the apparatus 2 is not in use, shown generally at 60. The receptacle 28 is also of a size to permit storage within basin 10 when the apparatus 2 is not in use (shown generally at 62). The drainage hose 26 may also be stored within basin 10 when the apparatus 2 is not in use. Thus, when cover 30 is in place over basin 10, and water supply means 50, drainage hose 26, basket 59 and receptacle 28 are stored as shown in FIG. 4, the entire apparatus 2 is in the form of a carrying case, as depicted in FIG. 3, and is easily portable from one location to another. Once at the desired location, the apparatus 2 may be unpacked and assembled for use in a matter of seconds, all by a single person.

In use therefore, the cover 30 is removed from the basin 10 by pivoting the main body portion upward about hinges 31*a* so that the front part of cover 30 can be freed from engagement with the back and should support 32 of basin 10. The receptacle 28 is removed from the basin 10 and the water supply means 50, drainage hose 28 and basket 59 are removed from the receptacle 28. Any other hair washing tools stored in the basin 10 for transport may be removed and now placed within the underside of cover 30 or basket 59 for convenient use. The water supply means 50 may be filled from a convenient sink or other means and, if desired, the cap 58 may be attached to the output means 54.

The apparatus 2 is positioned on the bed such that the patient's back and shoulders are resting comfortably on the back and shoulder support 32. The patient's neck is comfortably and securably seated within neck support 20, such that the patient's head rests on head support 22. One end of the drainage hose 26 is connected to the drainage aperture 24 in the convenient side of the bed, with the other end 64 of hose 26 connected to aperture 40 of receptacle 28. The oppositely facing drainage aperture 24 is capped to prevent drainage therefrom.

Figure 2:
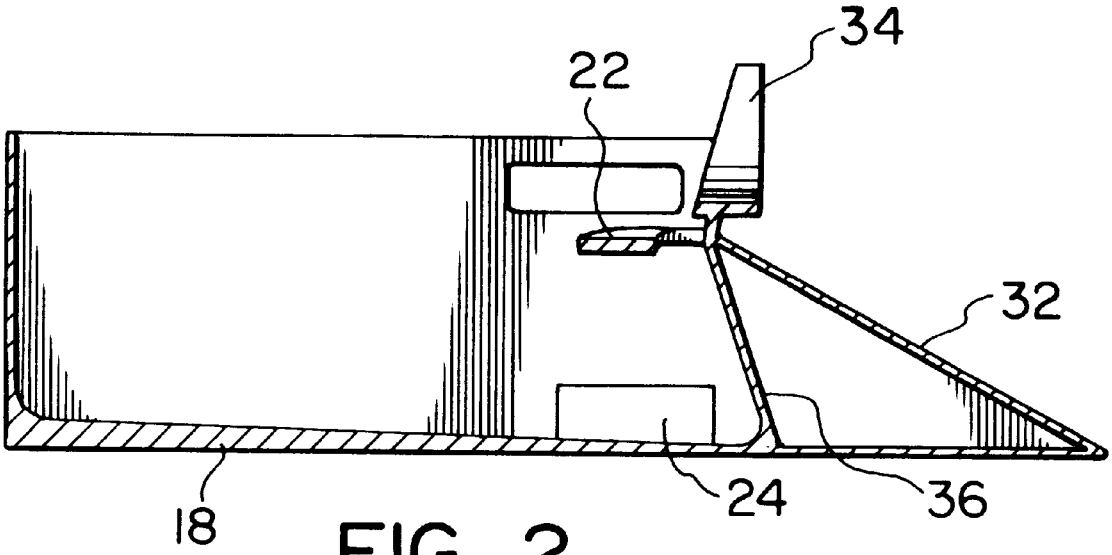
FIG. 2 is a cross-sectional view of the basin of the present invention taken along line 2—2 of FIG. 1.

As best seen in FIG. 2, the floor 18 of basin 10 is downwardly sloped towards the drainage openings 24. Therefore, in use, the waste water and shampoo residue flow towards the drainage openings 24. On very flexible surfaces, such as mattresses, the downward pressure of the patient's weight on the back rest 32 results in a natural forward slanting of the bottom of the basin allowing the waste water and shampoo residue to flow freely towards the drainage openings 24.

The water supply means 50 is of sufficient size to hold enough water for one normal washing process and the receptacle 28 is similarly of sufficient size to hold all the waste water and shampoo residue from the process. Thus, the apparatus 2 may be simply used by one person without the need for interrupting the washing process. Once that process is complete, the drainage hose 26 may be disconnected from aperture 40 of receptacle 28 and connected to aperture 66 in side wall 14 of basin 10 to prevent residue water within hose 26 from dripping on to the patient's bed or floor. The receptacle 28 may be then easily carried to a nearby sink or toilet, by means of the aperture 40 and handle 46.

Thus, it is apparent that there has been provided in accordance with the invention a portable hair washing apparatus that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim as my invention:

1. A portable hair washing apparatus comprising, in combination, a basin defined by a front wall, opposite facing side walls, a rear wall and a floor, said front wall having an upper portion angled outwardly and upwardly relative to said basin to serve as a shoulder and back support;

said basin having a neck support, a head support and drainage openings for draining waste water and debris from said basin;

a flexible drainage hose releasably connectable to said drainage openings;

a receptacle for receiving waste water and other debris from said hose;

a cover releasably securable to said basin and, when in position secured thereto, said cover and basin constituting a carrying case; and wherein said neck support, said head support and said back and shoulder support are contiguous with said upper portion and relatively positioned so as to comfortably maintain the head of a person whose hair is being washed elevated above water and other material within said basin during the hair washing operation while that person is lying on his or her back.

2. The apparatus of claim 1 wherein said neck support means comprises an elongated U-shaped opening in an upper portion of said front wall.

3. The apparatus of claim 1 wherein a lower portion of said front wall is angled outwardly and downwardly relative to said basin.

4. The apparatus of claim 1 wherein said floor is downwardly sloped towards said drainage openings.

5. The apparatus of claim 1 wherein back and shoulder support is sloped outwardly and downwardly relative to an outside face of said front wall.

6. The apparatus of claim 1 wherein each corner where said side walls meet said front and rear walls is rounded so as to facilitate cleaning of an inside portion of said basin.

7. The apparatus of claim 1 wherein said drainage openings comprises at least one drainage aperture positioned in a lower, forward portion of each of said side walls.

8. The apparatus of claim 7 further comprising means for selectively individually capping said drainage apertures.

9. The apparatus of claim 1 wherein said cover includes a handle at a forward portion thereof.

10. The apparatus of claim 1 further comprising a basket releasably attachable to said side walls or said rear wall.

11. The apparatus of claim 1 wherein said receptacle includes an aperture in an upper portion of an upstanding wall thereof, a handle at a lower portion of said upstanding wall and a removable cover.

12. The apparatus of claim 11 wherein said removable cover is transparent.

13. The apparatus of claim 1 further comprising a portable water supply means.

14. The apparatus of claim 13 wherein said water supply means comprises a pitcher having a handle and an output means.

15. The apparatus of claim 14 further comprising a splash-reducing interior baffle of an elongated, downwardly disposed member within said pitcher.

16. The apparatus of claim 14 wherein said water supply includes a perforated cap over said output such that the water flowing therefrom is in the form of a spray.

17. The apparatus of claim 14 wherein said water supply is of a size to permit storage in said receptacle, when the apparatus is not in use.

18. The apparatus of claim 17 wherein said receptacle is of a size to permit storage within said basin when the apparatus is not in use or when said apparatus is being transported when the cover means is secured to the basin to form said carrying case.

19. The apparatus of claim 14 wherein the pitcher is of a size so as to be able to hold sufficient water to complete the washing process with the need to refill the pitcher, and wherein the receptacle is of a sufficient size to to accomodate an entire amount of waste water shampoo residue and other debris from the hair wash in the basi.

* * * * *